US011292102B2

(12) United States Patent
Wang et al.

(10) Patent No.: US 11,292,102 B2
(45) Date of Patent: Apr. 5, 2022

(54) ABRASIVE BUFFING ARTICLES

(71) Applicants: SAINT-GOBAIN ABRASIVES, INC., Worcester, MA (US); SAINT-GOBAIN ABRASIFS, Conflans-Sainte-Honorine (FR)

(72) Inventors: Jianna Wang, Grafton, MA (US); Ying Cai, Niskayuna, NY (US); Mike D. Shappell, Henderson, KY (US); Shu Yang, Worcester, MA (US); Brahmanandam V. Tanikella, Northborough, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 606 days.

(21) Appl. No.: 16/232,603

(22) Filed: Dec. 26, 2018

(65) Prior Publication Data

US 2019/0202030 A1 Jul. 4, 2019

Related U.S. Application Data

(60) Provisional application No. 62/612,133, filed on Dec. 29, 2017.

(51) Int. Cl.
*B24D 3/00* (2006.01)
*B24D 18/00* (2006.01)
(Continued)

(52) U.S. Cl.
CPC ..... *B24D 3/004* (2013.01); *B24D 11/001* (2013.01); *B24D 13/08* (2013.01); *B24D 18/0027* (2013.01)

(58) Field of Classification Search
CPC ..... B24D 3/004; B24D 11/001; B24D 13/08; B24D 18/0027
See application file for complete search history.

(56) References Cited

U.S. PATENT DOCUMENTS 3,212,868 A 10/1965 Churchill
3,232,729 A 2/1966 Holland et al.
(Continued)

FOREIGN PATENT DOCUMENTS

CN 101844320 A 9/2010
CN 104209879 A * 12/2014
(Continued)

OTHER PUBLICATIONS

International Search Report and Written Opinion for PCT/US2018/067515, dated Apr. 19, 2019.
(Continued)

*Primary Examiner* — Pegah Parvini
*Assistant Examiner* — Ross J Christie
(74) *Attorney, Agent, or Firm* — Abel Schillinger, LLP; Joseph P. Sullivan

(57) ABSTRACT

The present disclosure relates to abrasive buffing articles ("abrasive buffs") and methods of making the same. The abrasive buffs include a substrate, such as a fabric, that has been impregnated with an abrasive polymeric composition that includes abrasive particles, such as primary abrasive particles and/or abrasive aggregates, such as spray dried abrasive aggregates. The abrasive buffs are flexible and capable of conforming to and effectively abrading, polishing, and buffing workpieces possessing a complex geometry.

21 Claims, 10 Drawing Sheets

(51) Int. Cl.

| | |
|---|---|
| ***B24D 11/00*** | (2006.01) |
| ***B24D 13/08*** | (2006.01) |

(56) References Cited

U.S. PATENT DOCUMENTS

| | | | | |
|---|---|---|---|---|
| 3,296,646 | A | 1/1967 | Bizovi | |
| 3,346,903 | A | 10/1967 | Darak, Jr. | |
| 3,724,140 | A | 4/1973 | Harper | |
| 3,778,241 | A | 12/1973 | Winter et al. | |
| 3,861,892 | A | 1/1975 | Wisdom, Jr. et al. | |
| 3,991,526 | A | 11/1976 | Frank et al. | |
| 4,282,011 | A | 8/1981 | Terpay | |
| 4,373,296 | A | 2/1983 | Kobayashi | |
| 4,611,362 | A | 9/1986 | Sinclair | |
| 4,746,565 | A | 5/1988 | Bafford et al. | |
| 5,306,319 | A | 4/1994 | Krishnan et al. | |
| 5,346,516 | A | 9/1994 | Alkhas et al. | |
| 5,492,550 | A | 2/1996 | Krishnan et al. | |
| 5,551,961 | A | 9/1996 | Engen et al. | |
| 5,573,619 | A | 11/1996 | Benedict et al. | |
| 5,611,825 | A | 3/1997 | Engen et al. | |
| 5,681,612 | A | 10/1997 | Benedict et al. | |
| 5,879,222 | A | 3/1999 | Robinson | |
| 5,902,360 | A | 5/1999 | Linzell | |
| 5,906,269 | A | 5/1999 | Zabron et al. | |
| 6,155,910 | A | 12/2000 | Lamphere et al. | |
| 6,295,687 | B1 | 10/2001 | Dehart | |
| 6,521,005 | B1 | 2/2003 | Vincent | |
| 6,547,655 | B1 | 4/2003 | Schaffner | |
| 6,595,843 | B1 | 7/2003 | Weber | |
| 6,672,952 | B1 | 1/2004 | Masmar et al. | |
| 6,695,941 | B2 | 2/2004 | Hartgrove et al. | |
| 6,838,149 | B2 | 1/2005 | Lugg | |
| 7,160,183 | B2 | 1/2007 | Weber | |
| 8,038,751 | B2 | 10/2011 | Starling | |
| 8,075,300 | B2 | 12/2011 | Zinniel | |
| 8,123,999 | B2 | 2/2012 | Priedeman, Jr. et al. | |
| 8,628,383 | B2 | 1/2014 | Starling et al. | |
| 8,765,045 | B2 | 7/2014 | Zinniel | |
| 9,004,984 | B1 | 4/2015 | Suzuki et al. | |
| 9,108,299 | B2 | 8/2015 | Moren et al. | |
| 9,623,541 | B2 | 4/2017 | Srihari et al. | |
| 2003/0194962 | A1 | 10/2003 | Weber | |
| 2005/0025967 | A1 | 2/2005 | Lawton et al. | |
| 2007/0298697 | A1 | 12/2007 | Charmoille et al. | |
| 2008/0220703 | A1 | 9/2008 | Jung | |
| 2009/0098814 | A1 | 4/2009 | Sung | |
| 2012/0015167 | A1 | 1/2012 | Beraud et al. | |
| 2012/0167478 | A1* | 7/2012 | Herbert | B24D 11/00 51/295 |
| 2013/0251647 | A1 | 9/2013 | Subkowski et al. | |
| 2013/0252520 | A1 | 9/2013 | Martinez | |
| 2014/0065935 | A1 | 3/2014 | Ramal, Jr. | |
| 2014/0099871 | A1* | 4/2014 | Moren | B24D 11/00 451/532 |
| 2016/0074998 | A1 | 3/2016 | Sharmila et al. | |
| 2016/0184974 | A1 | 6/2016 | Srihari et al. | |
| 2017/0210063 | A1 | 7/2017 | Andres et al. | |
| 2017/0225300 | A1 | 8/2017 | Beveridge et al. | |
| 2017/0334038 | A1 | 11/2017 | Poluha et al. | |
| 2018/0185986 | A1 | 7/2018 | Wang et al. | |

FOREIGN PATENT DOCUMENTS

| | | | |
|---|---|---|---|
| CN | 105081998 | A | 11/2015 |
| CN | 105773318 | A | 7/2016 |
| GB | 1019541 | A | 2/1966 |
| GB | 1019543 | A | 2/1966 |
| WO | 2016022449 | A1 | 2/2016 |
| WO | 2020026060 | A1 | 2/2020 |

OTHER PUBLICATIONS

Randall Elgin, "Sanding 3D Printed Objects: How to Get a Mirror-Polish Finish," Fiber Optic Center, 2016, 6 pgs. https://focenter.com/sanding-3d-printed-objects-how-to-get-a-mirror-polish-finish/.

Lindsey Frick, "How to Smooth 3D-Printed Parts," Machine Design, 2014, 3 pages. http://www.machinedesign.com/3d-printing/how-smooth-3d-printed-parts.

Peter Zelinski, "Smoothing the Way for Production 3D Printing," Additive Manufacturing, 2014, 1 pg. https://www.additivemanufacturing.media/articles/smoothing-the-way-for-production-3d-printing.

Courtney Armstrong, "Post processing for FDM printed parts," 3D Hubs, accessed Oct. 9, 2017, 23 pgs. nttps://www.3dhubs.com/knowledge-base/post-processing-fdm-printed-parts.

"How to Get Better 3D Printed Transparent Parts," GrabCAD Tutorials, 2017, 9 pgs. https://grabcad.com/tutorials/how-to-get-better-3d-printed-transparent-parts.

"Design for Additive Manufacturability: Finishing for FDM and PolyJet," stratasys Direct Manufacturing, accessed Oct. 9, 2017, 14 pages. https://www.stratasysdirect.com/wp-content/uploads/2016/10/finishing-for-fdm-and-polyjet-Rebrandeds-2.pdf.

"Choose the Right Buffing Wheel," Garfield Buff Company, 1 pg, accessed Oct. 5, 2017. http://www.garfieldbuff.com/BuffingWheelHints.aspx.

"How to Polish 3D Printed Clear Resin Models That Contain Many Details," Instructables.com, accessed Oct. 5, 2017, 9 pgs.

Davide Sher, "Airbus is Ready for Industrialization of 3D Printing in 2016, Peter Sander Reveals," 3D Printing Industry, 2016, 7 pgs. https://3dprintingindustry.com/news/airbus-is-ready-for-3d-printing-industrialization-in-2016-peter-sander-reveals-63986/.

"Buffing Tech Tips Summary," Metal Finishing Systems, 1 pg, accessed Oct. 5, 2017.

"Introduction to Buffing," Metal Finishing Systems, 9 pgs, accessed Oct. 5, 2017.

Michelle Matisons, "Sand Your Way to Smoother 3D Printed Parts by Following These Easy Steps," 3D Printing, 2016, 2 pgs.

Alec Richter, "How To: Smooth and Finish Your PLA Prints—Part 1," MatterHackers, 2016, 13 pgs.

Bridget Butler Millsaps, "Artists and Makers Say Goodbye to Sanding & Hello to Glossy 3D Prints with PolySmooth & Polysher," 3D Printing, 2016, 10 pgs.

Leslie Langnau, "Choosing a finishing method for additive manufacturing," 2014, 7 pgs.

"Technical Information B-RI 21—Laponite," BYK Additives & Instruments, 2014, 24 pages, BYK-Chemie GmbH.

* cited by examiner

ABRASIVE BUFFING ARTICLES

CROSS REFERENCE TO RELATED APPLICATION

This application claims priority under 35 U.S.C. § 119(e) to U.S. Patent Application No. 62/612,133 entitled "ABRASIVE BUFFING ARTICLES," by Jianna WANG et al., filed Dec. 29, 2017, which application is assigned to the current assignee hereof and incorporated herein by reference in its entirety.

FIELD OF THE DISCLOSURE

The present inventive embodiments relate to abrasive buffing articles ("abrasive buffs") and methods of making the same. The abrasive buffs include a substrate, such as a fabric, that has been impregnated with an abrasive polymeric composition that includes abrasive particles, such as spray dried abrasive aggregates. The abrasive buffs are flexible and capable of conforming to and effectively abrading, polishing, and buffing workpieces possessing a complex geometry.

BACKGROUND

Conventional buffs and buffing wheels (collectively referred to herein as "buffs") are used to polish parts made of metal, plastic, ceramic, glass, wood, stone, silicon, an optical materials, among others. Buffing is a finishing process which is typically accomplished a more rigorous stock removal treatment of a surface.

Buffs are frequently categorized as either "cut" buffs or "color" buffs. A "cut" buff is more aggressive and is typically employed with a coarser buffing compound, a medium to high pressure between the buff and the work piece, and the work piece is advanced against the direction of rotation of the buff. This results in the refinement of scratches on the work piece and yields a uniform matte finish. In contrast, a "color" buff is typically employed with a finer buffing compound, a medium to low pressure between the buff and the work piece, and the work piece is advanced in the direction of rotation of the buff. Application of a color buff results in a further refinement of scratches in the surface of the work piece and yields a reflective, mirror-like finish.

Conventional buffs are typically free of any fixed abrasive material. Instead, abrasive emulsions or solid waxy abrasive compounds are externally applied to the working surface of the buff, and periodically reapplied, during abrasive operations. Conventional buffing systems have various draw backs including high costs of maintaining and cleaning the abrasive compound transport and application systems, high material waste during buffing processes, and costs and concerns associated with disposal of abrasive compounds.

Therefore, there continues to be a demand for improved abrasive products and methods that can offer enhanced abrasive processing performance, efficiency, and improved surface quality.

BRIEF DESCRIPTION OF THE DRAWINGS

Embodiments are illustrated by way of example and are not limited in the accompanying figures.

Figure 1:
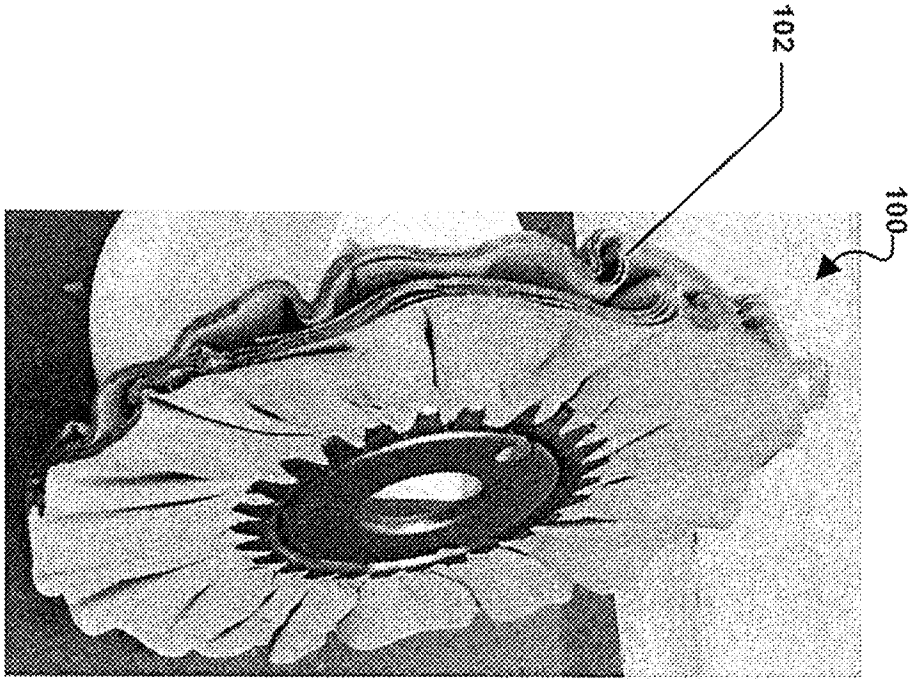
FIG. 1 is an image of an abrasive buff according to an embodiment.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

As used herein, the term "aggregate" may be used to refer to a particle made of a plurality of smaller particles that have been combined in such a manner that it is relatively difficult to separate or disintegrate the aggregate particle into smaller particles by the application of pressure or agitation. This is in contrast to the term "agglomerate," which is used herein to refer to a particle made up of a plurality of smaller particles that have been combined in such a manner that it is relatively easy to separate the agglomerate particle or disintegrate the agglomerate particle back into smaller particles, such as by the application of pressure or hand agitation.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the abrasive arts.

FIG. 1 shows an image of an embodiment of an abrasive buffing article (100) ("abrasive buff") comprising: a plurality of woven fabric layers (102). An abrasive composition is fixed to each of the fabric layers. Each of the fabric layers comprises a plurality of yarns, wherein the abrasive composition is disposed at least partially within the yarns and/or between the yarns. The abrasive composition comprises a polymeric binder and a plurality of abrasive particles dispersed in the polymeric binder.

Figure 2:
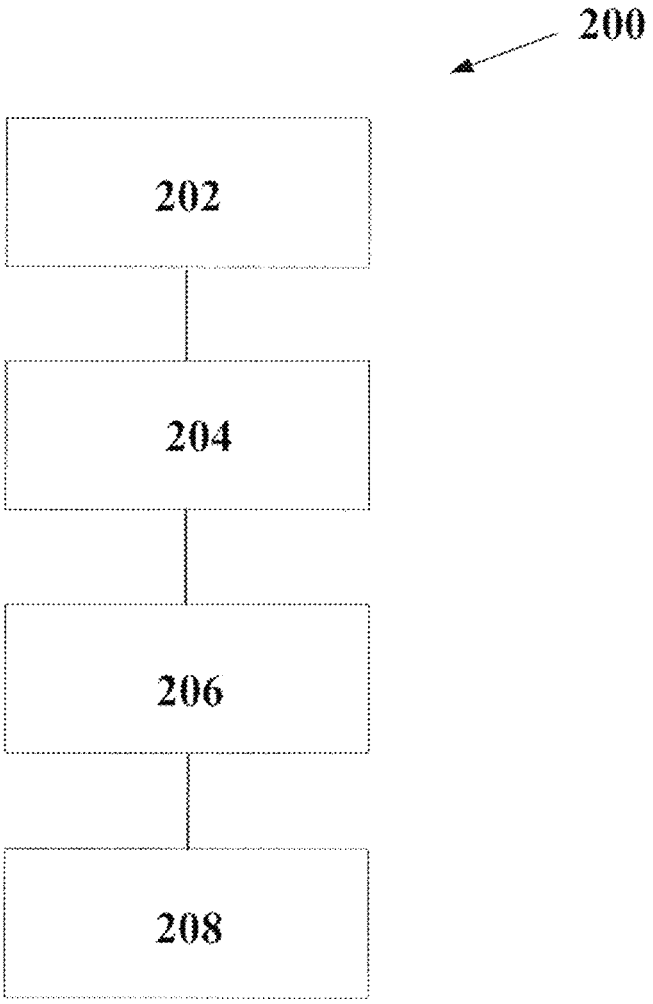
FIG. 2 is a process flow diagram of a method of making an abrasive buff according to an embodiment.

FIG. 2 shows a process flow diagram of a method 300 of forming an abrasive buff. Step 202 comprises mixing together a plurality of abrasive grains and a polymeric binder to form a precursor composition. In an embodiment, the abrasive grains can comprise abrasive aggregates. Step 204 comprises impregnating a woven fabric with the precursor composition. In an embodiment, the abrasive grains penetrate into and between the fibers of the woven fabric. In an embodiment, the precursor composition can be disposed on both surfaces (i.e., the front side and the back side) of the woven fabric. Step 206 comprises curing the precursor composition to form an abrasive woven cloth. Step 208 comprises forming the abrasive woven cloth into an abrasive buff.

Figure 3A:
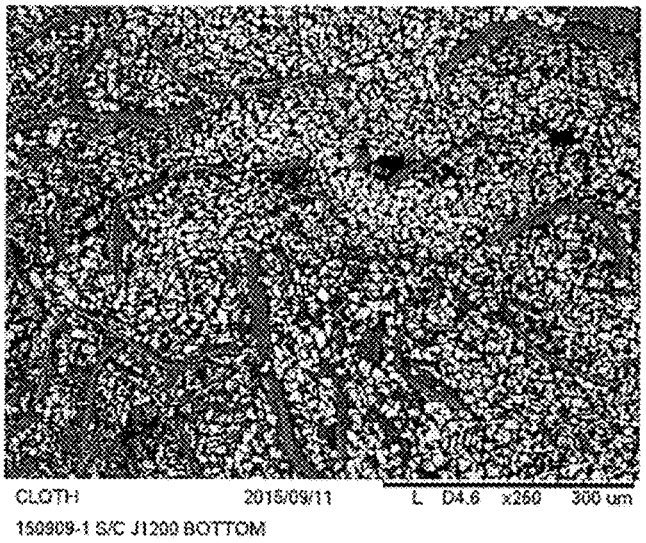
FIG. 3A is an image of an abrasive composition (abrasive grains in a polymeric binder composition) disposed on a surface of a woven fabric substrate of an abrasive buff where the abrasive grains penetrate into and between the fibers of the woven fabric substrate according to an embodiment.

FIG. 3A is an image of a surface of a woven fabric substrate of an abrasive buff where an abrasive composition (i.e., abrasive grains dispersed in a polymeric binder composition) is disposed on and in the fabric such that the abrasive composition (including the abrasive grains) penetrate into and between the fibers of the woven fabric substrate according to an embodiment.

Figure 3B:
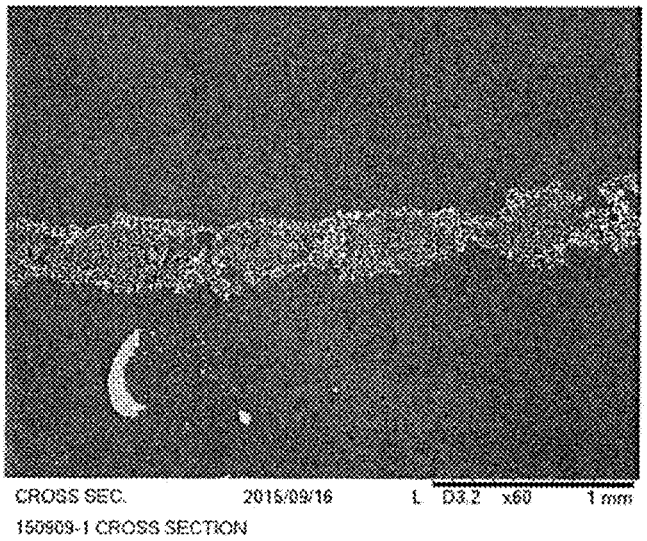
FIG. 3B is a cross sectional image of the same embodiment shown in FIG. 3A and shows that the abrasive composition is disposed on both surfaces (i.e., the front and the back) of the woven fabric substrate and the abrasive grains are penetrating into and between the fibers of the woven fabric.

FIG. 3B is a cross sectional image of the same embodiment shown in FIG. 3A and shows that the abrasive composition is disposed on both surfaces (i.e., the front side and the back side) of the woven fabric substrate. The abrasive composition (including the abrasive grains) is penetrating into and between the fibers of the woven fabric.

Abrasive Fabric Composition

The abrasive fabric of the abrasive buff can comprise varying amounts of abrasive composition. In an embodiment, the amount of abrasive composition can comprise as least 30 wt % of the abrasive fabric, such as at least 35% wt %, at least 38 wt %, at least 40 wt %, at least 42 wt %, or at least 44 wt % of the abrasive fabric. In another embodiment, the abrasive composition can comprise not greater than 85 wt % of the abrasive fabric, such as not greater than 80 wt %, not greater than 75 wt %, not greater than 70 wt %, not greater than 65 wt %, not greater than 60 wt %, or not greater than 55 wt % of the abrasive fabric. The amount of the abrasive composition can be within a range of any minimum or maximum value noted above. In a specific embodiment, the amount of the abrasive composition can comprise from at least 30 wt % to not greater than 85 wt % of the abrasive fabric, such as at least 35 wt % to not greater than 80 wt % of the abrasive fabric, such as at least 40 wt % to not greater than 75 wt % of the abrasive fabric, such as at least 40 wt % to not greater than 70 wt % of the abrasive fabric.

The abrasive fabric of the abrasive buff can comprise varying amounts of fabric. In an embodiment, the amount of fabric can comprise as least 10 wt % of the abrasive fabric, such as at least 15% wt %, at least 20 wt %, at least 25 wt %, at least 30 wt %, or at least 35 wt % of the abrasive fabric. In another embodiment, the fabric can comprise not greater than 70 wt % of the abrasive fabric, such as not greater than 65 wt %, not greater than 60 wt %, not greater than 55 wt %, or not greater than 50 wt % of the abrasive fabric. The amount of the fabric can be within a range of any minimum or maximum value noted above. In a specific embodiment, the amount of the fabric can comprise from at least 15 wt % to not greater than 70 wt % of the abrasive fabric, such as at least 20 wt % to not greater than 65 wt % of the abrasive fabric.

Add-on Weight

Alternatively, the amount of abrasive composition comprising the abrasive fabric can be expressed as an amount or "weight" (mass per unit area) of an abrasive composition added to the fabric (i.e., add-on weight). In an embodiment, the add-on weight can comprise at least 10 grams per square meter ("GSM"), such as least 25 GSM, at least 50 GSM, at least 75 GSM, at least 100 GSM, or at least 150 GSM. In another embodiment, the add-on weight can comprise not greater than 800 GSM, such as not greater than 700 GSM, not greater than 600 GSM, not greater than 500 GSM, not greater than 400 GSM, not greater than 300 GSM, not greater than 275 GSM, not greater than 250 GSM, not greater than 225 GSM, or not greater than 200 GSM. The add-on weight can be within a range of any minimum or maximum value noted above. In a specific embodiment, the add-on weight can comprise a weight of at least 50 GSM to not greater than 800 GSM, such as at least 75 GSM to not greater than 500 GSM, as at least 100 GSM to not greater than 300 GSM.

Fabric Layer

An abrasive buff can comprise a plurality of fabric layers. In an embodiment, each of the fabric layers can comprise an abrasive composition fixed to each of the fabric layers. In an embodiment, the fabric layers can comprise a woven fabric, a nonwoven fabric, or a combination thereof. In an embodiment, the abrasive composition can be disposed on a first side of the fabric. In an embodiment, the abrasive composition is further disposed on a second side of the fabric.

In a specific embodiment, the fabric comprises a woven fabric. In an embodiment, the woven fabric can comprise a plurality of yarns, such as warp yarns and weft yarns. In an embodiment, the abrasive composition can be disposed at least partially within or between the yarns, such as between the warp and weft yarns. In an embodiment, the abrasive composition can be further disposed through the fabric between the yarns from the first side of the fabric to the second side of the fabric.

In another specific embodiment, the fabric comprises a nonwoven fabric. As used herein the term "nonwoven fabric or web" means a web having a structure of individual fibers or threads that are interlaid, but not in an identifiable manner as in a knitted fabric. Nonwoven fabrics or webs can be formed from many processes such as for example, meltblowing processes, spunbonding processes, and bonded carded web processes. The basis weight of a nonwoven fabric is usually expressed in ounces of material per square yard (osy) or grams per square meter (gsm) and the fiber diameters are usually expressed in microns. (Note that to convert from osy to gsm, multiply osy by 33.91). In an embodiment, the nonwoven fabric can comprise a spunbond fabric (also known as a "spunlaid" fabric) of spunbonded fibers. "Spunbonded fibers" refers to small diameter fibers that are formed by extruding molten thermoplastic material as filaments from a plurality of fine, usually circular capillaries of a spinneret with the diameter of the extruded filaments then being rapidly reduced. Spunbond fibers are generally not tacky when they are deposited onto a collecting surface. Spunbond fibers are generally continuous.

In an embodiment, a spunbond fabric can comprise a meltblown fabric of meltblown fibers. "Meltblown fibers" means fibers formed by extruding a molten thermoplastic material through a plurality of fine, usually circular, die capillaries as molten threads or filaments into converging high velocity, usually hot, gas (e.g. air) streams that attenuate the filaments of molten thermoplastic material to reduce their diameter, which may be to microfiber diameter.

Thereafter, the meltblown fibers are carried by the high velocity gas stream and are deposited on a collecting surface to form a web of randomly disbursed meltblown fibers. Meltblown fibers are microfibers that may be continuous or discontinuous, are generally smaller than 10 microns in average diameter, and are generally tacky when deposited onto a collecting surface.

In an embodiment, the spunbond fabric comprises bonds that hold the web together. In an embodiment, the bonds can comprise thermal bonds (thermal bonding), hydro-entangling bonds, resin bonds, or a combination thereof. Thermal bonding can comprise flat bonding, point bonding (also known as pattern bonding), and through-air bonding. Flat bonding occurs by applying heat and consistent pressure in the form of a flat calender across the web, which creates a smooth surface of fibers bonded to each other. Point bonding (also known as pattern bonding) is the process of applying a heated roll with a pattern embossed in the roll. Fibers are bonded together only at the specific pattern points of the roll. Alternatively, point bonding can be accomplished by ultrasonic welding. Point bonding can comprise any or a combination of various point bonding patterns, such as an S-weave pattern, an Expanded Hansen-Pennings (EHP) pattern, a wire weave pattern, a Point Unbonded Pattern (PUB), or a combination thereof. Thru-air bonding draws the web through a heated drum, creating bonds throughout the fabric without applying a specific pressure to the web. In a specific embodiment, the fabric can comprise a nonwoven, spunbond, point bond fabric.

In an embodiment, the abrasive composition can be disposed at least partially within or between the fibers of the nonwoven web. In an embodiment, the abrasive composition can be further disposed through the nonwoven fabric between the fibers of the web from the first side of the fabric to the second side of the fabric.

Number of Fabric Layers

An abrasive buff can comprise a plurality of fabric layers (also called "plys"). In an embodiment, the number of fabric layers can be at least 2 layers, such as at least 4 layers, at least 6 layers, at least 8 layers, or at least 10 layers. In another embodiment, the number of layers can be not greater than 20 layers, such as not greater than 18 layers, not greater than 16 layers, not greater than 14 layers, or not greater than 12 layers. The number of fabric layers can be within a range of any minimum or maximum value noted above. In a specific embodiment, the number of fabric layers can comprise from at least 2 layers to not greater than 20 layers, such as from at least 4 layers to not greater than 18 layers, at least 6 layers to not greater than 16 layers, or at least 8 layers to not greater than 14 layers.

Weave

In an embodiment, the fabric layer can comprise a woven cloth. In an embodiment, the woven cloth can comprise one or a plurality of woven patterns, including a plain weave, a basket weave, a rib weave, a balanced plain weave, a twill weave, a satin weave, or a combination thereof.

Thread Count—Warp

The thread count of a woven cloth can vary in the warp direction and vary in the weft direction. In an embodiment, the woven cloth can comprise at least 50 threads per inch in the warp direction, such as least 55 threads per inch, at least 60 threads per inch, at least 65 threads per inch, at least 70 per inch, at least 75 threads per inch, at least 80 threads per inch, at least 85 threads per inch, or at least 90 threads per inch. In another embodiment, the woven cloth can comprise not greater than 300 threads per inch, such as not greater than 280 threads per inch, not greater than 260 threads per inch, not greater than 240 threads per inch, not greater than 220 threads per inch, or not greater than 200 threads per inch. The threads per inch can be within a range of any minimum or maximum value noted above. In a specific embodiment, the amount of threads per inch can comprise from at least 50 threads per inch to not greater than 300 threads per inch in the warp direction, such as from 50 threads per inch to not greater than 100 threads per inch, or from 100 threads per inch to not greater than 300 threads per inch.

Thread Count—Weft

The thread count of a woven cloth can vary in the weft direction and vary in the weft direction. In an embodiment, the woven cloth can comprise at least 50 threads per inch in the weft direction, such as least 55 threads per inch, at least 60 threads per inch, at least 65 threads per inch, at least 70 per inch, at least 75 threads per inch, at least 80 threads per inch, at least 85 threads per inch, or at least 90 threads per inch. In another embodiment, the woven cloth can comprise not greater than 300 threads per inch, such as not greater than 280 threads per inch, not greater than 260 threads per inch, not greater than 240 threads per inch, not greater than 220 threads per inch, or not greater than 200 threads per inch. The threads per inch can be within a range of any minimum or maximum value noted above. In a specific embodiment, the amount of threads per inch can comprise from at least 50 threads per inch to not greater than 300 threads per inch in the weft direction, such as from 50 threads per inch to not greater than 100 threads per inch, or from 100 threads per inch to not greater than 300 threads per inch.

Ratio—Warp:Weft

The ratio of warp threads to weft threads of a woven fabric layer can vary. In an embodiment, the woven cloth comprises a ratio of warp threads to weft threads (warp: weft) ranging from 1:6 (e.g., 50/300 thread count) to 6:1 (e.g., 300/50 thread count), such as from 1:2 to 2:1, or from 1:1.8 to 1:1.

Fabric Weight

The "weight" (mass per area) of a fabric (whether woven or nonwoven) can vary. In an embodiment, the fabric weight can comprise at least 10 grams per square meter ("GSM") ($g/m^2$), such as least 25 GSM, at least 50 GSM, at least 75 GSM, at least 100 GSM, or at least 150 GSM. In another embodiment, the fabric weight can comprise not greater than 800 GSM GSM, such as not greater than 700 GSM, not greater than 600 GSM, not greater than 500 GSM, not greater than 400 GSM, not greater than 300 GSM, not greater than 275 GSM, not greater than 250 GSM, not greater than 225 GSM, or not greater than 200 GSM. The fabric weight can be within a range of any minimum or maximum value noted above. In a specific embodiment, the fabric weight can comprise a weight of at least 10 GSM to not greater than 800 GSM, such as at least 25 GSM to not greater than 500 GSM, as at least 50 GSM to not greater than 400 GSM, or at least 100 GSM to not greater than 300 GSM.

Ratio of Fabric Weight to Add-on Weight

The ratio of fabric weight to abrasive composition add-on weight ("add-on weight") can vary and can beneficially affect the performance of the fixed abrasive buff. In an embodiment, the ratio of fabric weight to add-on weight (fabric weight:add-on weight) can range from 1:0.5 to 1:3, such as from 1:0.6 to 1:2.75, or from 1:0.7 to 1:2.5.

Fabric Type

The fabric can comprise natural fibers, synthetic fibers, or a combination thereof. Natural fibers can comprise one or more natural fibers. In an embodiment, natural fibers can comprise cellulose, cotton, flax, hemp, jute, ramie, sisal, linen, silk, or a combination thereof. In another embodiment, natural fibers can comprise cotton. In a specific embodiment, natural fibers can consist essentially of cotton. Synthetic fibers can comprise one or more synthetic fibers. In an embodiment, synthetic fibers can comprise a polymer, a glass, a metal, a rubber, carbon, or a combination thereof. In another embodiment, synthetic fibers can comprise a polymer fiber. In a specific embodiment, a polymer fiber can comprise nylon, acrylic, olefin, polyester, rayon, modal, Dyneema, or a combination thereof. In a particular embodiment, a polymer fiber comprises polyester. In a specific embodiment, a synthetic fiber can consist essentially of polyester. In another particular embodiment, a polymer fiber comprises nylon. In a specific embodiment, a synthetic fiber can consist essentially of nylon.

Fabric Bias

Figure 10:
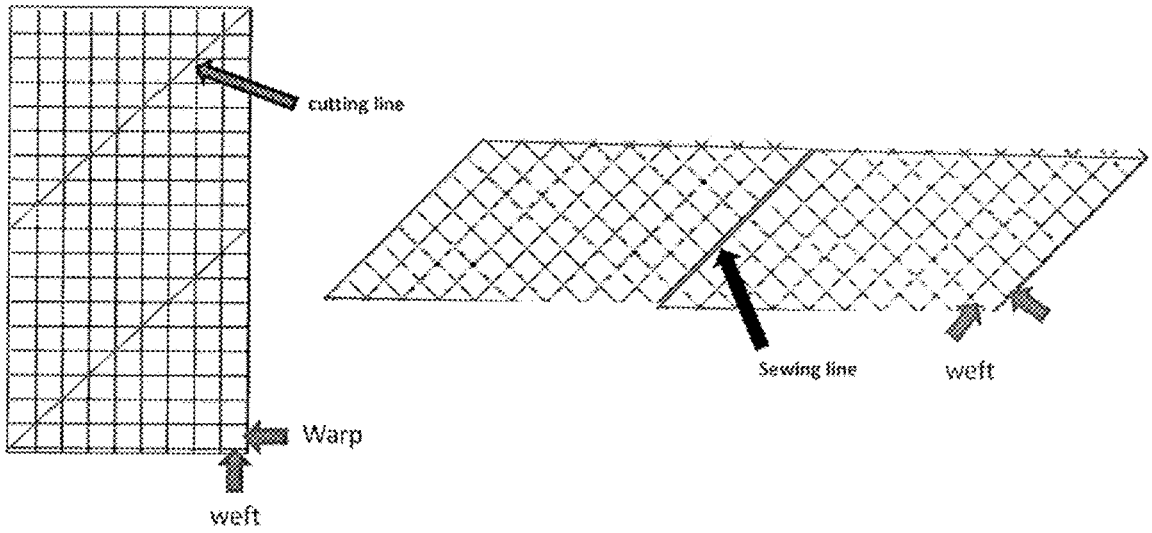
FIG. 10 illustrates an embodiment of a fabric having a bias.

The fabric can have a specific grain. For woven textiles, grain refers to the orientation of the weft and warp threads. The fabric grain can be a straight grain, a cross grain, or a bias grain. A fabric can be cut in any orientation and the chosen grain will affect the way the fabric hangs and stretches. Generally, a piece of fabric is said to be cut on a particular grain when the main seams of the finished piece are aligned with that grain. A fabric has a bias grain (or "a bias") when the fabric's warp and weft threads are at 45 degrees to its major seam lines. In an embodiment, the fabric comprises a bias. FIG. 10 illustrates an embodiment of a fabric having a bias. In a specific embodiment, the fabric of a fixed abrasive buff can be biased so that the warp and weft lines are in 45 degree contact angle on a work piece. In an embodiment, the fabric comprises a bias to prevent fraying and wear of the warp and/or weft lines.

Fabric Thickness

The thickness of a fabric can vary and can beneficially affect the performance of the fixed abrasive buff. In an embodiment, the fabric thickness can comprise at least 50 microns, such as least 100 microns, at least 150 microns, at least 200 microns, at least 250 microns, at least 300 microns, at least 350 microns, or at least 400 microns. In another embodiment, the fabric thickness can comprise not greater than 2000 microns, such as not greater than 1800 microns, not greater than 1600 microns, not greater than 1500 microns, not greater than 1300 microns, not greater than 1250 microns, not greater than 1100 microns, not greater than 1000 microns, not greater than 900 microns, not greater than 800 microns, not greater than 700 microns, not greater than 600 microns, not greater than 550 microns, not greater than 550 microns, or not greater than 500 microns. The fabric thickness can be within a range of any minimum or maximum value noted above. In a specific embodiment, the fabric thickness can comprise a thickness of at least 50 microns to not greater than 2000 microns, such as at least 100 microns to not greater than 1500 microns, at least 150 microns to not greater than 750 microns, 250 microns to not greater than 650 microns, as at least 350 microns to not greater than 550 microns.

Abrasive Composition (Cured Composition)

The abrasive buff comprises an abrasive composition fixed to each of the fabric layers. The abrasive composition can comprise a plurality of abrasive particles (also called abrasive grains herein) disposed on or in a polymeric binder. In an embodiment, the abrasive composition can further comprise a rheology modifier.

The amount of abrasive particles comprising the abrasive composition can vary. In an embodiment, the abrasive composition can comprise at least 20 wt % abrasive particles, such as least 25 wt %, at least 30 wt %, at least 35 wt %, at least 40 wt %, at least 45 wt %, at least 50 wt %, at least 55 wt %, or at least 60 wt % abrasive particles. In another embodiment, the abrasive composition can comprise not greater than 90 wt % abrasive particles, such as not greater than 85 wt %, not greater than 80 wt %, or not greater than 75 wt % abrasive particles. The abrasive particles can be within a range of any minimum or maximum value noted above. In a specific embodiment, the amount of abrasive particles in the abrasive composition can comprise from at least 20 wt % to not greater than 90 wt %, such as from at least 40 wt % to not greater than 85 wt %, or from 60 wt % abrasive particles to not greater than 80 wt % abrasive particles.

The amount of polymeric binder comprising the abrasive composition can vary. In an embodiment, the abrasive composition can comprise at least 10 wt % polymeric binder, such as least 15 wt %, at least 20 wt %, or at least 25 wt % polymeric binder. In another embodiment, the abrasive composition can comprise not greater than 80 wt % polymeric binder, such as not greater than 75 wt %, not greater than 70 wt %, not greater than 65 wt %, not greater than 60 wt %, not greater than 55 wt %, not greater than 50 wt %, not greater than 40 wt %, not greater than 35 wt %, or not greater than 30 wt % polymeric binder. The polymeric binder can be within a range of any minimum or maximum value noted above. In a specific embodiment, the amount of polymeric binder in the abrasive composition can comprise from at least 10 wt % to not greater than 80 wt %, such as from at least 15 wt % to not greater than 70 wt %, or from 20 wt % polymeric binder to not greater than 60 wt % polymeric binder.

The amount of rheology modifier (also called a thickener herein) comprising the abrasive composition can vary. In an embodiment, the abrasive composition can comprise at least 0.3 wt % rheology modifier, such as least 0.4 wt %, at least 0.5 wt %, or at least 0.6 wt % rheology modifier. In another embodiment, the abrasive composition can comprise not greater than 10 wt % rheology modifier, such as not greater than 8 wt %, not greater than 6 wt %, not greater than 4 wt %, or not greater than 2 wt %. The rheology modifier can be within a range of any minimum or maximum value noted above. In a specific embodiment, the amount of rheology modifier in the abrasive composition can comprise from at least 0.3 wt % to not greater than 10 wt %, such as from at least 0.4 wt % to not greater than 6 wt %.

Abrasive Composition Thickness (Abrasive Coating Thickness)

The total thickness of the abrasive composition (i.e., the total abrasive coating thickness) can vary and can beneficially affect the performance of the fixed abrasive buff. It will be appreciated that if the abrasive fabric is coated on one side only, the total abrasive coating thickness will be equal to the thickness of the coating on one side. Similarly, if the abrasive fabric is coated on both sides, the total abrasive coating thickness will be equal to the sum of the thickness of the coating on both sides. In an embodiment, the total abrasive coating thickness can comprise at least 20 microns, such as least 40 microns, at least 60 microns, at least 80 microns, at least 100 microns, at least 120 microns, or at least 140 microns. In another embodiment, the abrasive coating thickness can comprise not greater than 300 microns, such as not greater than 280 microns, not greater than 260 microns, not greater than 240 microns, not greater than 220 microns, not greater than 200 microns, not greater than 180 microns, or not greater than 160 microns. The abrasive coating thickness can be within a range of any minimum or maximum value noted above. In a specific embodiment, the abrasive coating thickness can comprise a thickness of at least 60 microns to not greater than 300 microns, such as at least 80 microns to not greater than 260 microns, as at least 100 microns to not greater than 200 microns.

Ratio of Abrasive Composition Thickness to Fabric Thickness

The ratio of fabric thickness to abrasive composition add-on thickness ("add-on thickness") can vary and can beneficially affect the performance of the fixed abrasive buff. In an embodiment, the ratio of fabric thickness to add-on thickness (fabric thickness: add-on thickness) can range from 1:0.1 to 1:0.9, such as from 1:0.2 to 1:0.8, or from 1:0.3 to 1:0.6.

Abrasive Particles

Abrasive particles can include essentially single phase inorganic materials, such as alumina, silicon carbide, silica, ceria, and harder, high performance superabrasive particles such as cubic boron nitride and diamond. Additionally, the abrasive particles can include composite particulate materials. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures. In certain embodiments, the abrasive particles comprise primary particles, aggregates, or a combination thereof. In certain embodiments, when the abrasive particles are at least partially abrasive aggregates, the abrasive aggregates may comprise unfired abrasive aggregates having a generally spheroidal or toroidal shape that are formed from a composition of abrasive grit particles and a nanoparticle binder (Nanozyte aggregates). In certain embodiments, the aggregates may be hollow and may comprise an interior space (Nanozyte aggregates).

In an embodiment, the abrasive particles are blended with a polymeric binder to form abrasive slurry. Alternatively, the abrasive particles are applied over the polymeric binder after the polymeric binder is coated on the backing. Optionally, a functional powder can be applied over the abrasive regions to prevent the abrasive regions from sticking to a patterning tooling. Alternatively, patterns can be formed in the abrasive regions absent the functional powder.

The abrasive particles can be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, and Tripoli. For example, the abrasive particles can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive particles comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

In certain embodiments, a portion of the abrasive particles of the aggregate component may include a coating of a polymer component disposed between the abrasive particle and the polymeric binder. In certain embodiments, the polymer component may be directly in contact with the abrasive particles.

Particle Size

In an embodiment, the abrasive particles can have an average particle size not greater than 4000 microns, such as not greater than 2000 microns, such as not greater than about 1500 microns, not greater than about 1000 microns, not greater than about 750 microns, not greater than about 500 microns, not greater than about 250 microns, not greater than about 100 microns, or not greater than 50 microns. In another embodiment, the abrasive particle size can be at least 0.1 microns, such as at least 1 micron, at least 5 microns, at least 6 microns, at least 7 microns, at least 8 microns, at least 9 microns, at least 10 microns, at least 15 microns, at least 20 microns, or at least 25 microns. The average particle size can be within a range of any minimum or maximum value noted above. In a specific embodiment, the average particle size can comprise from at least 1 micron to not greater than 2000 microns, such as from at least 5 microns to not greater than 1000 microns, at least 5 microns to not greater than 750 microns, at least 6 microns to not greater than 500 microns, at least 7 microns to not greater than 250 microns, or at least 8 microns to not greater than 100 microns. The particle size of the abrasive particles is typically specified to be the longest dimension of the abrasive particle. Generally, there is a range distribution of particle sizes. In some instances, the particle size distribution is tightly controlled.

Polymeric Binder

The polymeric binder can be formed of a single polymer or a blend of polymers. The binder composition can be formed from an epoxy composition, acrylic composition, a phenolic composition, a polyurethane composition, a phenolic composition, a polysiloxane composition, an acrylic latex composition, a thermoset rubber composition, a thermoset elastomer composition, a styrene butadiene rubber composition, an acrylonitrile-butadiene rubber composition, a polybutadiene composition, or a combination thereof. In a specific embodiment, the polymeric binder can comprise a self crosslinking carboxylated styrene butadiene composition. In another specific embodiment, the polymeric binder can comprise a carboxylated acrylic composition. In addition, the binder composition can include active filler particles, as described above, additives, or a combination thereof. In certain embodiments, the polymeric binder can be flexible after curing such that the coated fabric has a "soft" hand, also known as a soft "drape", so that the fabric feels soft to the touch, is flexible, and conformable around an object, not stiff.

The polymeric binder generally includes a polymer matrix, which binds abrasive particles to the backing or to a compliant coat, if such a compliant coat is present. Typically, the polymeric binder is formed of cured polymeric binder. In an embodiment, the polymeric binder includes a polymer component and a dispersed phase.

The polymeric binder can include one or more reaction constituents or polymer constituents for the preparation of a polymer. A polymer constituent can include a monomeric molecule, a polymeric molecule, or a combination thereof. The polymeric binder can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The polymeric binder can include a monomer, an oligomer, a polymer, or a combination thereof. In a particular embodiment, the polymeric binder includes monomers of at least two types of polymers that when cured can crosslink. For example, the binder formulation can include epoxy constituents and acrylic constituents that when cured form an epoxy/acrylic polymer. In a specific embodiment, the polymeric binder can comprise at least one of a polyurethane, a phenolic, an acrylic latex, or a combination thereof.

The polymeric binder can comprise a desirable glass transition temperature (Tg) that can contribute to beneficial abrasive properties. In an embodiment, the polymeric binder can comprise a glass transition temperature (Tg) of not greater than 60° C., not greater than 50° C., not greater than 40° C., not greater than 30° C., not greater than 20° C., not greater than 10° C., not greater than 0° C., or not greater than −1° C. In another embodiment, the polymeric binder can comprise a glass transition temperature (Tg) of at least −30° C., at least −25° C., at least −20° C., or at least −15° C. The glass transition temperature (Tg) can be within a range of any minimum or maximum value noted above. In a specific embodiment, the glass transition temperature (Tg) can comprise from at least −30° C. to not greater than 30° C., such as from at least −20° C. to not greater than 20° C. In a specific embodiment, the polymeric binder comprises a glass transition temperature (Tg) in a range of at least −30° C. to not greater than −10° C., such as −28° C. to not greater than −10° C. In a another specific embodiment, the polymeric binder comprises a glass transition temperature (Tg) in a range of at least −10° C. to not greater than 10° C., such as −5° C. to not greater than 5° C.

Rheology Modifier

In an embodiment, the abrasive composition can comprise a rheology modifier. The rheology modifier can comprise a cellulose composition, a fumed silica composition, a colloidal silicate composition, a polysaccharide composition, or a combination thereof. In a specific embodiment, the cellulose composition can comprise a hydroxypropyl cellulose composition. In another specific embodiment, the colloidal silicate composition can comprise a layered colloidal silicate composition, such as laponite, a synthetic smectite clay that is a layered hydrous magnesium silicate. In another specific embodiment, the polysaccharide composition can comprise a gum composition, such as a Xanthan gum composition.

EMBODIMENTS LISTING

Embodiment 1

A fixed abrasive buff comprising:
a plurality of fixed abrasive cloths; and
a central hub,
wherein the fixed abrasive cloths are attached to the hub,
wherein each abrasive cloth comprises
an abrasive composition fixed to a fabric,
wherein the fabric comprises a woven fabric, a nonwoven fabric, or a combination thereof,
wherein the abrasive composition comprises a polymeric binder and a plurality of abrasive particles dispersed in the polymeric binder, and
wherein the abrasive composition is disposed within the fibers of the fabric.

Embodiment 2

The fixed abrasive buff of embodiment 1, wherein the nonwoven fabric comprises a spunbond fabric.

Embodiment 3

The fixed abrasive of embodiment 2, wherein the spun bond fabric comprises a point bond fabric.

Embodiment 4

The fixed abrasive buff of embodiment 1, wherein the polymeric binder comprises an acrylic composition, a styrene butadiene composition, or a combination thereof.

Embodiment 5

The fixed abrasive buff of embodiment 3, wherein the polymeric binder has a glass transition temperature (Tg) of at least −30° C. and not greater than 5° C.

Embodiment 6

The fixed abrasive buff of embodiment 1, wherein the fabric comprises a fabric weight of at least 25 to not greater than 500 g/m2.

Embodiment 7

The fixed abrasive buff of embodiment 6, wherein the abrasive composition comprises an add-on weight of at least 75 to not greater than 500 g/m2.

Embodiment 8

The fixed abrasive buff of embodiment 7, further comprising a ratio of fabric weight to add-on weight ranges from 1:0.5 to 1:3.

Embodiment 9

The fixed abrasive buff of embodiment 1, wherein the fabric comprises a thickness of at least 50 microns to not greater than 2000 microns.

Embodiment 10

The fixed abrasive buff of embodiment 9, wherein the abrasive composition comprises a thickness of a thickness of at least 60 microns to not greater than 300 microns.

Embodiment 11

The fixed abrasive buff of embodiment 10, further comprising a ratio of fabric thickness to abrasive composition thickness ranging from of 1:0.2 to 1:0.8.

Embodiment 12

The fixed abrasive buff of embodiment 1, wherein the abrasive composition comprises
15 wt % to 90 wt % of the abrasive cloth.

Embodiment 13

The fixed abrasive buff of embodiment 1, wherein the fabric comprises
10 wt % to 85 wt % of the abrasive cloth.

Embodiment 14

The fixed abrasive buff of embodiment 1, wherein the fabric comprises nylon, cotton, or a combination thereof.

Embodiment 15

The fixed abrasive buff of embodiment 1, wherein the abrasive composition is disposed on a first side and a second side of the fabric.

Embodiment 16

The fixed abrasive buff of embodiment 1, wherein the abrasive composition comprises
20 wt % to 90 wt % of abrasive grains and
10 wt % to 80 wt % of the polymeric binder.

Embodiment 17

The fixed abrasive buff of embodiment 16, wherein the abrasive composition further comprises
0.1 wt % to 10 wt % of a rheology modifier.

Embodiment 18

The fixed abrasive buff of embodiment 1, wherein the rheology modifier comprises a cellulose compound, a fumed silica, a colloidal layered silicate, or a combination thereof.

Embodiment 19

The fixed abrasive buff of embodiment 15, wherein the abrasive composition is disposed from the first side to the second side between fibers of the fabric.

Embodiment 20

A fixed abrasive buff comprising:
a plurality of fabric layers; and
an abrasive composition fixed to each of the fabric layers,
wherein the abrasive composition is disposed at least partially within each of the fabric layers, wherein the abrasive composition comprises a polymeric binder and a plurality of abrasive particles dispersed in the polymeric binder, wherein the fabric layer comprises a nonwoven spun bond point bond fabric, and wherein the polymeric binder the polymeric binder comprises a styrene butadiene composition having a glass transition temperature (Tg) of at least −30° C. and not greater than 20° C.

EXAMPLES

The properties and advantage of the present disclosure are illustrated in further detail in the following nonlimiting examples. Unless otherwise indicated, temperatures are expressed in degrees Celsius, pressure is ambient, and concentrations are expressed in weight percentages.

Components Listing:

Hycar® 26796—acrylic emulsion from Lubrizol Advanced Materials, Inc.

Rovene® 5550-crosslinking carboxylated styrene butadiene emulsion from Mallard Creek Polymers Klucel™—M-hydroxypropyl cellulose thickener from Ashland.

Xanthan gum—polysaccaride thickener from Cargill.

Aerosil® 150—hydrophilic fumed silica from Evonik.

Triton X-100 Wetting agent from Dow Chemical.

Surfynol® DF70 Defoamer from Air Product.

Greige Cloth, biased cotton, from Garfield Buff Company (Fairfield, N.J.). The cloth has a thread count of 86/80, cloth weight is 12.3 lbs/rm.

Spun-bund Nylon non-woven fabric from Cerex Advanced Fabrics, Type 30, 3OSY, 6.9 lbs/rm Spun-bund Nylon non-woven fabric from Cerex Advanced Fabrics, Type 70, 4OSY, 9.2 lbs/rm Silicon carbide, F graded: F320

Example 1—Preparation of Abrasive Compositions (Samples S1-S2)

Sample abrasive compositions S1-S2 having different types and amounts of abrasive particles and polymeric binder were prepared using the formulations listed in Table 1. The components were thoroughly mixed together and the resulting compositions were stored for later use. The formulations are presented on a "dry" weight (i.e., cured) basis.

TABLE 1

Abrasive Composition Formulation S1-S2

| | S1 % Dry | S2 % Dry |
|---|---|---|
| Hycar ® 26796 | 30.35 | |
| Rovene ® 5550 | | 40.49 |
| Silicon Carbide F320 | 68.96 | 59.31 |
| Water | | |
| 6% Klucel | 0.69 | 0.21 |
| Wet Agent Triton X-100 | | |
| DF70 | | |
| Total | 100 | 100 |

Example 2—Preparation of Abrasive Cloths (Samples S3-S6)

The sample abrasive compositions S1-S2 were used to prepare various abrasive cloths. The construction of abrasive cloths S3-S6 is shown in Table 2.

TABLE 2

Construction of Abrasive Cloths S3-S6

| Sample | Fabric | Abrasive Formulation |
|---|---|---|
| C1 | Greige 86/60 | None |
| S3 | Greige 86/80 | S2 |
| S4 | Non-woven T30 | S2 |
| S5 | Non-woven T70 | S1 |
| S6 | Non-woven T70 | S2 |

Figure 4A:
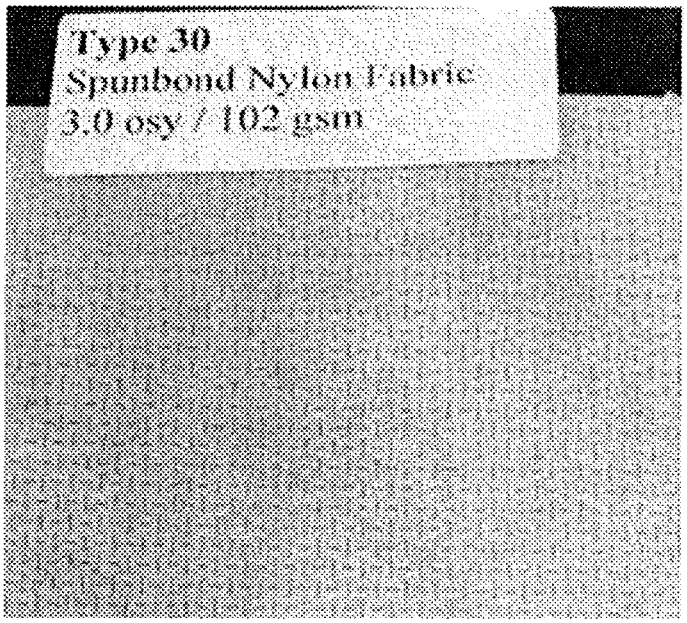
FIG. 4A is an illustration of a non-woven fabric prior to coating according to an embodiment.
Figure 4B:
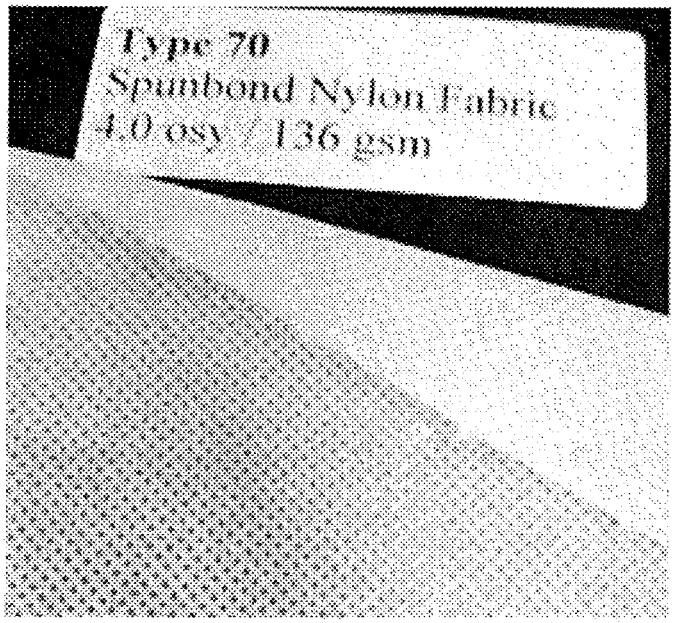
FIG. 4B is an illustration of a non-woven fabric prior to coating according to an embodiment.
Figure 5:
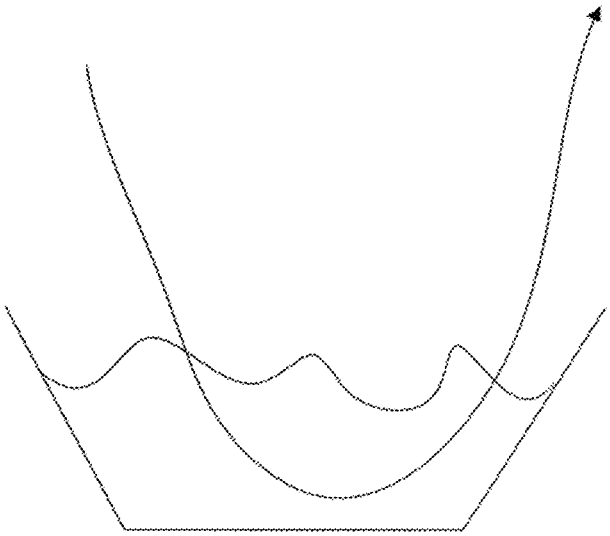
FIG. 5 is an illustration of a woven fabric substrate being dip coated with an abrasive composition according to an embodiment.

An uncoated "blank" cloth according to Table 2 was unwound from a roll and dipped in the sample abrasive compositions using a dip tank. FIG. 4A and FIG. 4B depict non-woven material T30 and T70 prior to coating, respectively. A portion of the uncoated 86/60 Greige cloth was used as a control (C1). The dipped cloth was run through metering rolls to remove excess liquid. FIG. 5 shows an embodiment of the dipping step. The impregnated fabric was passed through an oven to cure the abrasive composition. The cured abrasive cloth was collected on a winding station for further processing. Abrasive sample cloths S3-S6 were produced as described. A portion of the sample abrasive cloths were cut into 3-inch OD circles ("discs") for fabric analysis. The results of the testing are shown in Table 3.

TABLE 3

Sample Abrasive Cloth (S3-S6)

| Sample Disc 3" OD round | Total Weight (g) | Cured Add-On Abrasive Composition Weight (g) | Cloth (wt %) | Abrasive Composition (wt %) |
|---|---|---|---|---|
| Control 1 (Blank Cloth) | 0.8 | 0.0 | 100% | 0% |
| S3 | 1.51 | 0.68 | 55% | 45% |
| S4 | 1.62 | 1.17 | 28% | 72% |
| S5 | 1.75 | 1.14 | 35% | 65% |
| S6 | 1.75 | 1.14 | 35% | 65% |

Figure 7A:
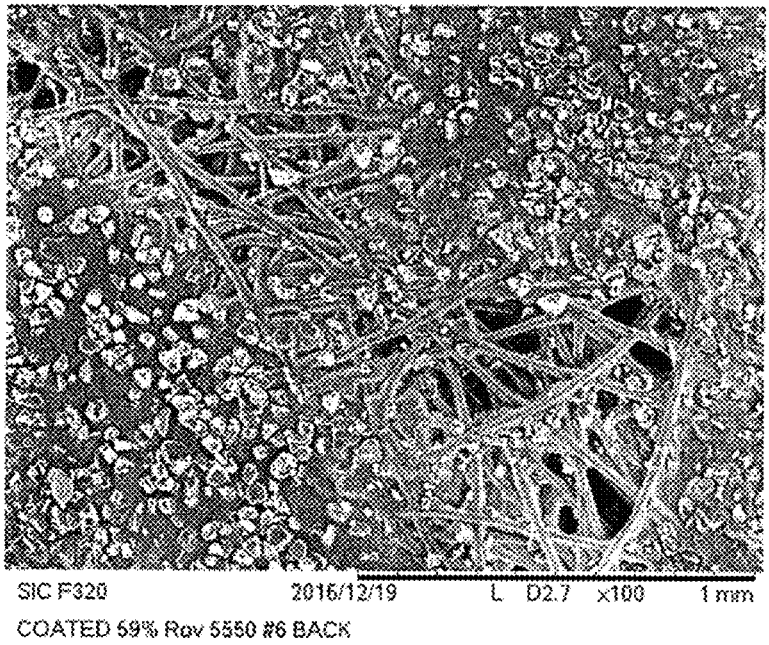
FIG. 7A is an image of an abrasive composition (abrasive grains in a polymeric binder composition) disposed on a surface of a non-woven fabric substrate of an abrasive buff where the abrasive grains penetrate into and between the fibers of the non-woven fabric substrate according to an embodiment.
Figure 7B:
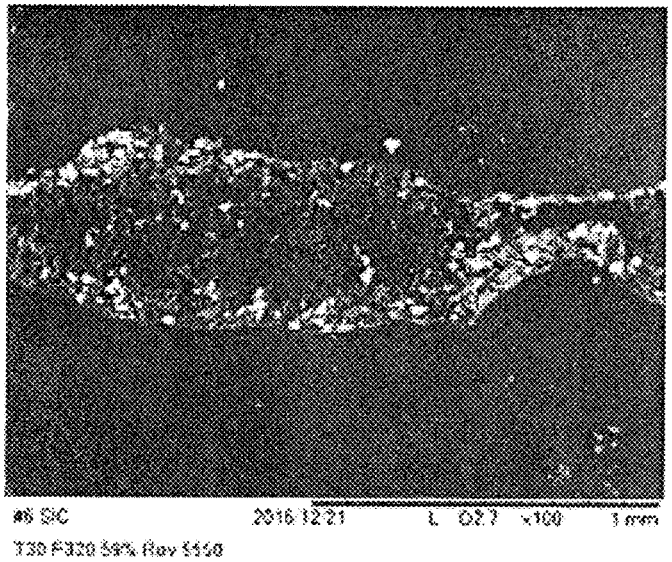
FIG. 7B is a cross sectional image of the same embodiment shown in FIG. 7A and shows that the abrasive composition is disposed on both surfaces of the non-woven fabric substrate and the abrasive grains penetrating into and between the fibers of the non-woven fabric.
Figure 8A:
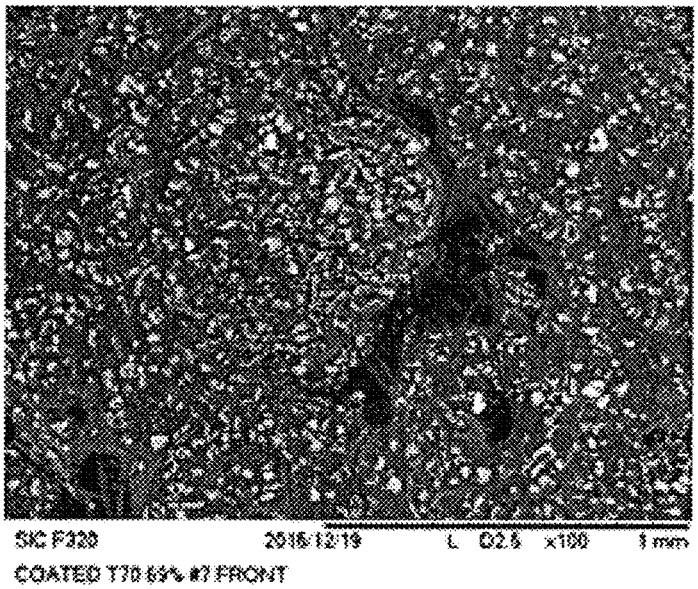
FIG. 8A is an image of an abrasive composition (abrasive grains in a polymeric binder composition) disposed on a surface of a non-woven fabric substrate of an abrasive buff where the abrasive grains penetrate into and between the fibers of the non-woven fabric substrate according to an embodiment.
Figure 8B:
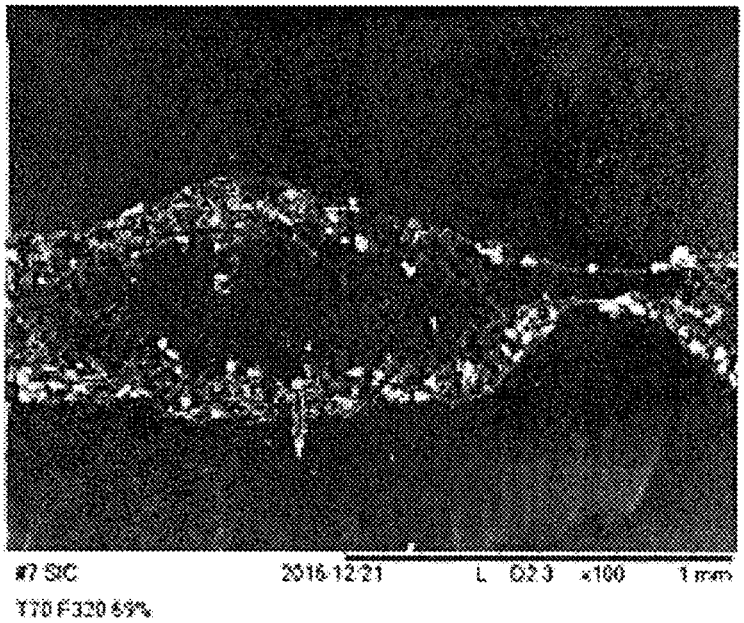
FIG. 8B is a cross sectional image of the same embodiment shown in FIG. 8A and shows that the abrasive composition is disposed on both surfaces of the non-woven fabric substrate and the abrasive grains penetrating into and between the fibers of the non-woven fabric.

FIGS. 7A and 7B show images of abrasive cloth sample S4. FIGS. 8A and 8B show images of abrasive cloth sample S5.

Example 3—Preparation of Abrasive Buffs (Samples S3-S6)

Buff wheels were created according to conventional methods (Garfield Buff Company, Fairfield, N.J.). The sample abrasive cloths were tucked into a metal clinch ring and a metal plate with center ("arbor") hole was inserted. The buff wheel specifications were: 12 plys, 7.5" OD, 3" ID, arbor hole ⅞".

Example 4. Abrasive Testing of Buffs

Figure 6:
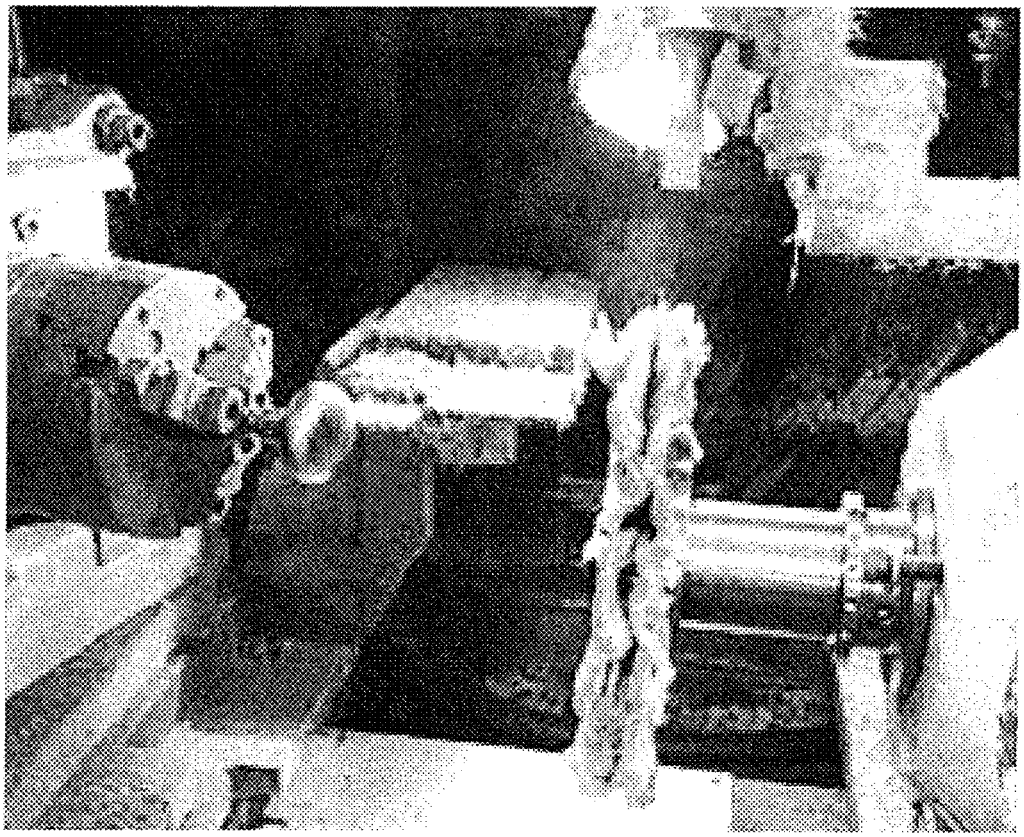
FIG. 6 is an image showing an abrasive buff according to an embodiment set up to conduct abrasive testing of the abrasive article.

Abrasive testing of sample fixed abrasive buffs S3-S6 was conducted on an Heald Cinternal cylindrical grinder. The goal was to investigate the polishing and wear behavior of the fixed abrasive buffs in an automated process compared to traditional bar compound buffing by hand. FIG. 6 displays the test setup.

Test workpieces were brass door knobs. Testing was directed to surface finish refinement and surface gloss improvement of rough workpiece. The initial surface of the workpieces were pre-ground with a grinding belt to an initial surface roughness Ra of 40-45 μinches.

Figure 9:
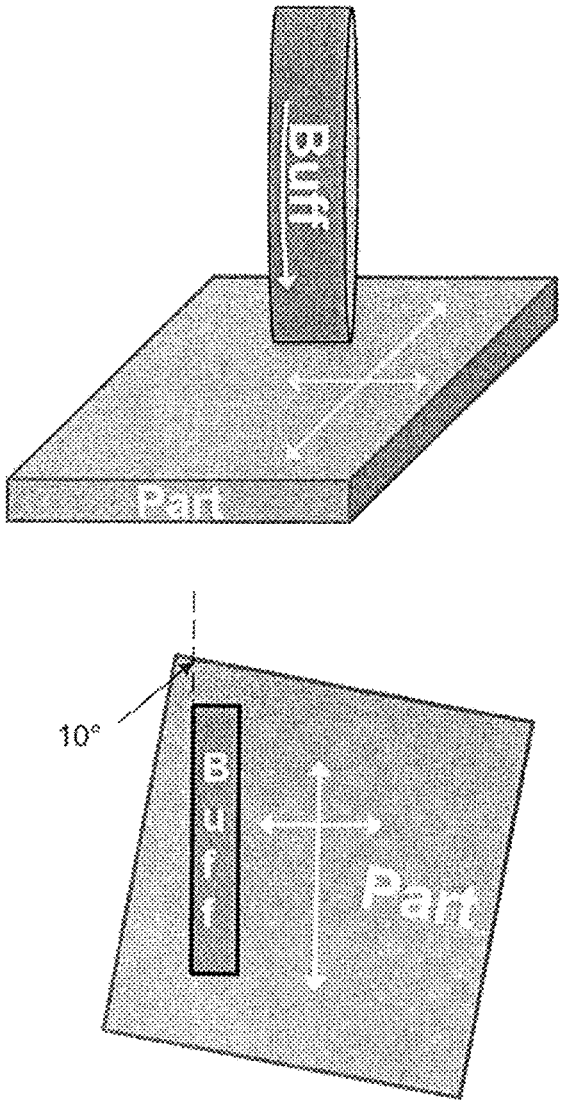
FIG. 9 is an illustration of the testing set up for conducting 10 Degree Angle testing on a work piece.

For comparison, one door knob from the field was used for comparison with the automated buffing results. The comparative part was then buffed with a control C1 and bar compound. The surface finish and surface gloss of both sides of the workpiece were measured. Buffing was conducted at a 10° angle from the grinding marks as shown in FIG. 9. All testing parameters are shown in Table 4.

TABLE 4

Performance Testing C1 and S3-S6
Performance Test Parameters

| | |
|---|---|
| Part Speed | 100 ft/minute |
| Buff speed (rpm) | 7500 |
| Oscillation speed | 300 in/min |
| Mush depth | 1 in. |
| Coolant | Water |
| Buff time | 30 sec/cycle |

Sample inventive fixed abrasive buffs were tested against the conventional method of buffing (i.e., buffing with an uncoated buff and periodically applying traditional bar compound to the buff surface during buffing). The abrasive performance results after 60 second buffing time and 90 second buffing time are shown in Table 5.

TABLE 5

Performance Results C1 and S3-S6

| Sample | | 60 sec. | 90 sec. | | 60 sec. | 90 sec. |
|---|---|---|---|---|---|---|
| C1 | Ra (μin) | 12.7 | 11.2 | Rmax(μin) | 160 | 40 |
| S3 | Ra (μin) | 14.2 | 11.8 | Rmax(μin) | 135 | 115 |
| S4 | Ra (μin) | 11.8 | 11 | Rmax(μin) | 84 | 62 |
| S5 | Ra (μin) | 12.4 | 11.8 | Rmax(μin) | 132 | 140 |
| S6 | Ra (μin) | 12.4 | 10.1 | Rmax(μin) | 108 | 90 |

Example 5—Preparation of Additional Abrasive Compositions (Samples S7-S9)

Sample abrasive compositions S7-S9 having different types and amounts of abrasive particles, polymeric binder, and rheology modifiers were prepared using the formulations listed in Table 6. The components were thoroughly mixed together and the resulting compositions were stored for later use. The formulations are presented on a "dry" weight (i.e., cured) basis.

TABLE 6

Abrasive Composition Formulations S7-S9

| | S7 % Dry | S8 % Dry | S9 % Dry |
|---|---|---|---|
| Rovene ® 5550 | 33.7% | 33.3% | 32.7% |
| Silicon Carbide F320 | 66% | 65.7% | 64.5 |
| Water | | | |
| 5% Laponite | | 1.0%0 | |
| Xanthan Gum | 0.3% | | 0.2 |
| Aerosil 150 | | | 2.6 |
| Wet Agent Triton X-100 | | | |
| Defoamer | | | |
| Total | 100 | 100 | 100 |

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A fixed abrasive buff comprising:
a plurality of fixed abrasive cloths; and
a central hub,
wherein the fixed abrasive cloths are attached to the hub,
wherein each abrasive cloth comprises
an abrasive composition fixed to a fabric,
wherein the fabric comprises a woven fabric, a nonwoven fabric, or a combination thereof, wherein the abrasive composition comprises a polymeric binder and a plurality of abrasive particles dispersed in the polymeric binder,
wherein the abrasive composition is disposed within the fibers of the fabric,
wherein the fabric comprises a thickness of at least 50 microns to not greater than 2000 microns,
wherein the abrasive composition comprises a thickness of at least 60 microns to not greater than 300 microns, and
wherein the abrasive buff comprises a ratio of fabric thickness to abrasive composition thickness ranging from of 1:0.2 to 1:0.8.

2. The fixed abrasive buff of claim 1, wherein the nonwoven fabric comprises a spunbond fabric.

3. The fixed abrasive of claim 2, wherein the spun bond fabric comprises a point bond fabric.

4. The fixed abrasive buff of claim 1, wherein the polymeric binder comprises an acrylic composition, a styrene butadiene composition, or a combination thereof.

5. The fixed abrasive buff of claim 3, wherein the polymeric binder has a glass transition temperature (Tg) of at least −30° C. and not greater than 5° C.

6. The fixed abrasive buff of claim 1, wherein the fabric comprises a fabric weight of at least 25 to not greater than 500 g/m$^2$.

7. The fixed abrasive buff of claim 6, wherein the abrasive composition comprises an add-on weight of at least 75 to not greater than 500 g/m$^2$.

8. The fixed abrasive buff of claim 7, further comprising a ratio of fabric weight to add-on weight ranges from 1:0.5 to 1:3.

9. The fixed abrasive buff of claim 1, wherein the abrasive composition comprises 15 wt % to 90 wt % of the abrasive cloth.

10. The fixed abrasive buff of claim 1, wherein the fabric comprises 10 wt % to 85 wt % of the abrasive cloth.

11. The fixed abrasive buff of claim 1, wherein the fabric comprises nylon, cotton, or a combination thereof.

12. The fixed abrasive buff of claim 1, wherein the abrasive composition is disposed on a first side and a second side of the fabric.

13. The fixed abrasive buff of claim 1, wherein the abrasive composition comprises 20 wt % to 90 wt % of abrasive grains and 10 wt % to 80 wt % of the polymeric binder.

14. The fixed abrasive buff of claim 13, wherein the abrasive composition further comprises 0.1 wt % to 10 wt % of a rheology modifier.

15. The fixed abrasive buff of claim 14, wherein the rheology modifier comprises a cellulose compound, a fumed silica, a colloidal layered silicate, or a combination thereof.

16. The fixed abrasive buff of claim 12, wherein the abrasive composition is disposed from the first side to the second side between fibers of the fabric.

17. A fixed abrasive buff comprising:

a plurality of fabric layers; and an abrasive composition fixed to each of the fabric layers, wherein the abrasive composition is disposed at least partially within each of the fabric layers, wherein the abrasive composition comprises a polymeric binder and a plurality of abrasive particles dispersed in the polymeric binder, wherein the fabric layer comprises a nonwoven spun bond point bond fabric, and wherein the polymeric binder the polymeric binder comprises a styrene butadiene composition having a glass transition temperature (Tg) of at least −30° C. and not greater than 20° C., wherein the fabric comprises a thickness of at least 50 microns to not greater than 2000 microns, wherein the abrasive composition comprises a thickness of at least 60 microns to not greater than 300 microns.

18. The fixed abrasive buff of claim 1, wherein the abrasive particles comprise silicon carbide.

19. The fixed abrasive buff of claim 18, wherein the abrasive composition has a coating density of no greater than 200 gsm.

20. The fixed abrasive buff of claim 17, wherein the abrasive particles comprise silicon carbide.

21. The fixed abrasive buff of claim 18, wherein the abrasive composition has a coating density of no greater than 200 gsm.

* * * * *